US008770572B2

(12) United States Patent
Uchino

(10) Patent No.: US 8,770,572 B2
(45) Date of Patent: Jul. 8, 2014

(54) CONVEYING APPARATUS AND IMAGE RECORDING APPARATUS HAVING THE SAME

(71) Applicant: Brother Kogyo Kabushiki Kaisha, Aichi (JP)

(72) Inventor: Yuta Uchino, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 99 days.

(21) Appl. No.: 13/628,712

(22) Filed: Sep. 27, 2012

(65) Prior Publication Data

US 2013/0134016 A1 May 30, 2013

(30) Foreign Application Priority Data

Nov. 25, 2011 (JP) ..... 2011-257221

(51) Int. Cl.
*B65H 3/44* (2006.01)
*G03G 21/00* (2006.01)

(52) U.S. Cl.
USPC ..... 271/9.09; 271/9.13; 399/391; 399/392

(58) Field of Classification Search
USPC ..... 271/9.09, 9.13; 399/391, 392
See application file for complete search history.

(56) References Cited

U.S. PATENT DOCUMENTS

| | | | | |
|---|---|---|---|---|
| 5,526,104 | A * | 6/1996 | Kawano | 399/381 |
| 5,646,720 | A * | 7/1997 | Song | 399/361 |
| 6,526,254 | B2 * | 2/2003 | Futagawa | 399/396 |
| 7,451,972 | B2 * | 11/2008 | Fukada et al. | 271/9.09 |
| 7,526,226 | B2 * | 4/2009 | Ito et al. | 399/107 |
| 7,784,786 | B2 * | 8/2010 | Tashiro et al. | 271/264 |
| 7,810,811 | B2 * | 10/2010 | Suzuki et al. | 271/270 |
| 8,262,079 | B2 * | 9/2012 | Uchino | 271/10.03 |
| 8,493,639 | B2 * | 7/2013 | Samoto et al. | 358/498 |
| 8,508,819 | B2 * | 8/2013 | Asada et al. | 358/498 |
| 8,585,051 | B2 * | 11/2013 | Arakane | 271/258.01 |
| 2011/0050780 | A1 | 3/2011 | Mizutani et al. | |

FOREIGN PATENT DOCUMENTS

| | | |
|---|---|---|
| JP | 2010-150021 A | 7/2010 |
| JP | 2011-051178 A | 3/2011 |

* cited by examiner

*Primary Examiner* — Douglas Hess
(74) *Attorney, Agent, or Firm* — Scully, Scott, Murphy & Presser, PC

(57) ABSTRACT

In a conveying apparatus, a support member supports a second guide member such that the second guide member is pivotable between a first position and a second position, a downstream-side edge of the second guide member in a sheet conveying direction being closer to a first guide member than to a fourth guide member when the second guide member is in a first position, the downstream-side edge of the second guide member being closer to the fourth guide member than to the first guide member when the second guide member is in the second position.

11 Claims, 5 Drawing Sheets

CONVEYING APPARATUS AND IMAGE RECORDING APPARATUS HAVING THE SAME

CROSS REFERENCE TO RELATED APPLICATION

This application claims priority from Japanese Patent Application No. 2011-257221 filed Nov. 25, 2011. The entire content of this priority application is incorporated herein by reference.

TECHNICAL FIELD

The present invention relates to a conveying apparatus for conveying a sheet and an image recording apparatus having the conveying apparatus and recording an image on the sheet.

BACKGROUND

There is known a conveying apparatus that conveys a sheet within a conveying path formed inside the conveying apparatus. An image recording apparatus, such as a printer and a multifunction peripheral, is one example of the conveying apparatus.

Some image recording apparatuses include a plurality of conveying paths in the inside of the apparatuses.

Some image recording apparatuses have a manual feed tray on their back surface. A user uses the manual feed tray to insert a sheet onto the inside of the apparatus.

There has been proposed an image recording apparatus that has a manual feed tray and a plurality of conveying paths. The image recording apparatus has a curved path extending from a sheet feed tray to a recording unit and a manual feed conveying path extending from the manual feed tray to a position where the manual feed conveying path converges into the curved path. The recording unit records an image on a sheet that has been conveyed to the recording unit.

SUMMARY

In view of the foregoing, it is an object of the present invention to provide an improved conveying apparatus and an improved recording apparatus having the conveying apparatus, in which two conveying paths for conveying sheets converge and which can convey sheets reliably regardless of which conveying path through which the sheets are guided.

In order to attain the above and other objects, the invention provides a conveying apparatus including: a housing; a conveying roller; a first guide member; a second guide member; a third guide member; a fourth guide member; and a support member. The conveying roller is configured to convey a sheet. The first guide member is located at a downstream side of the conveying roller in a sheet conveying direction and that has a first guide part defining an inside of a curved path and configured to guide the sheet conveyed by the conveying roller. The second guide member has a second guide part defining an outside of the curved path and configured to guide the sheet conveyed by the conveying roller, the second guide part being disposed opposing the first guide part. The third guide member defines a manual feed conveying path that converges from an outside of the housing into a downstream-side portion of the curved path in the sheet conveying direction and being configured to support a sheet inserted into the inside of the housing from the outside of the housing. The fourth guide member defines the manual feed conveying path and being disposed at a position opposing the third guide member and a downstream-side edge portion of the first guide member. The support member is configured to support the second guide member such that the second guide member is pivotable between a first position and a second position, a downstream side edge of the second guide member in the sheet conveying direction being closer to the first guide member than to the fourth guide member when the second guide member is in the first position, the downstream side edge of the second guide member being closer to the fourth guide member than to the first guide member when the second guide member is in the second position.

According to another aspect, the present invention provides an image recording apparatus including: the conveying apparatus; and a recording unit that is configured to record an image on a portion of a sheet that has passed the first guide part by being conveyed by the conveying roller.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, a multifunction peripheral (MFP) 10 will be described according to an embodiment of the invention.

In the following description, up and down directions 7 are defined based on the state of the MFP 10 when the MFP 10 is set up for use; front and rear directions 8 are defined under the assumption that the side of the MFP 10 provided with an opening 13 is positioned on the near side (front side); and left and right directions 9 are defined based on the perspective of a user facing the near side (front side) of the MFP 10.

Overall Structure of the MFP 10

Figure 1:
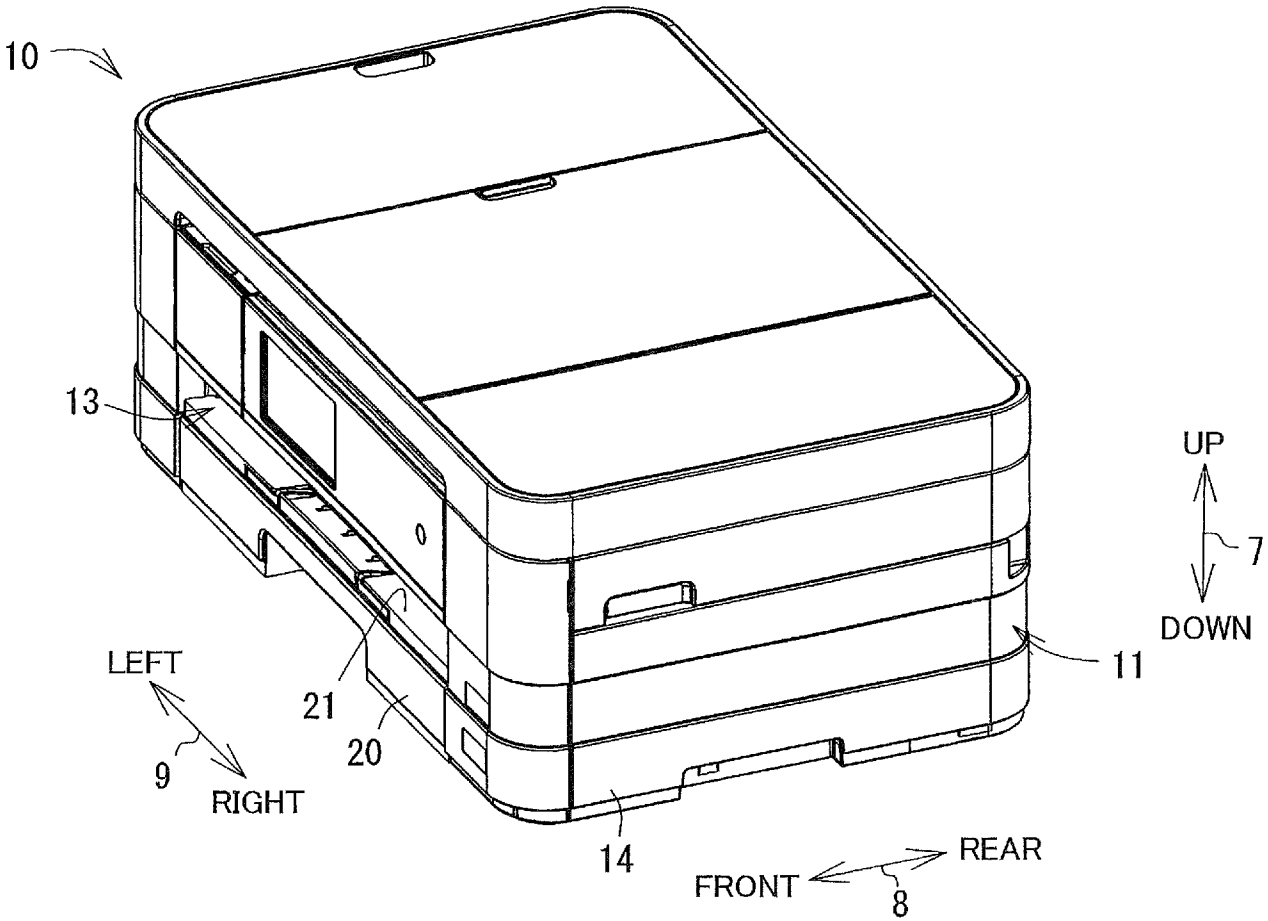
FIG. 1 is a perspective view of a multifunction peripheral, according to an embodiment of the present invention, showing an external appearance of the multifunction peripheral.

As shown in FIG. 1, the MFP 10 has a generally rectangular parallelepiped shape. The MFP 10 includes a printing unit 11 that employs an inkjet recording method to record images on recording sheets 12 (see FIG. 2). The MFP 10 has various functions, including a facsimile function and a printing function.

The printing unit 11 has a casing 14. An opening 13 is aimed in the front surface of the casing 14. A sheet tray 20 capable of holding recording sheets 12 of various sizes, and a discharge tray 21 are disposed in the opening 13.

Figure 2:
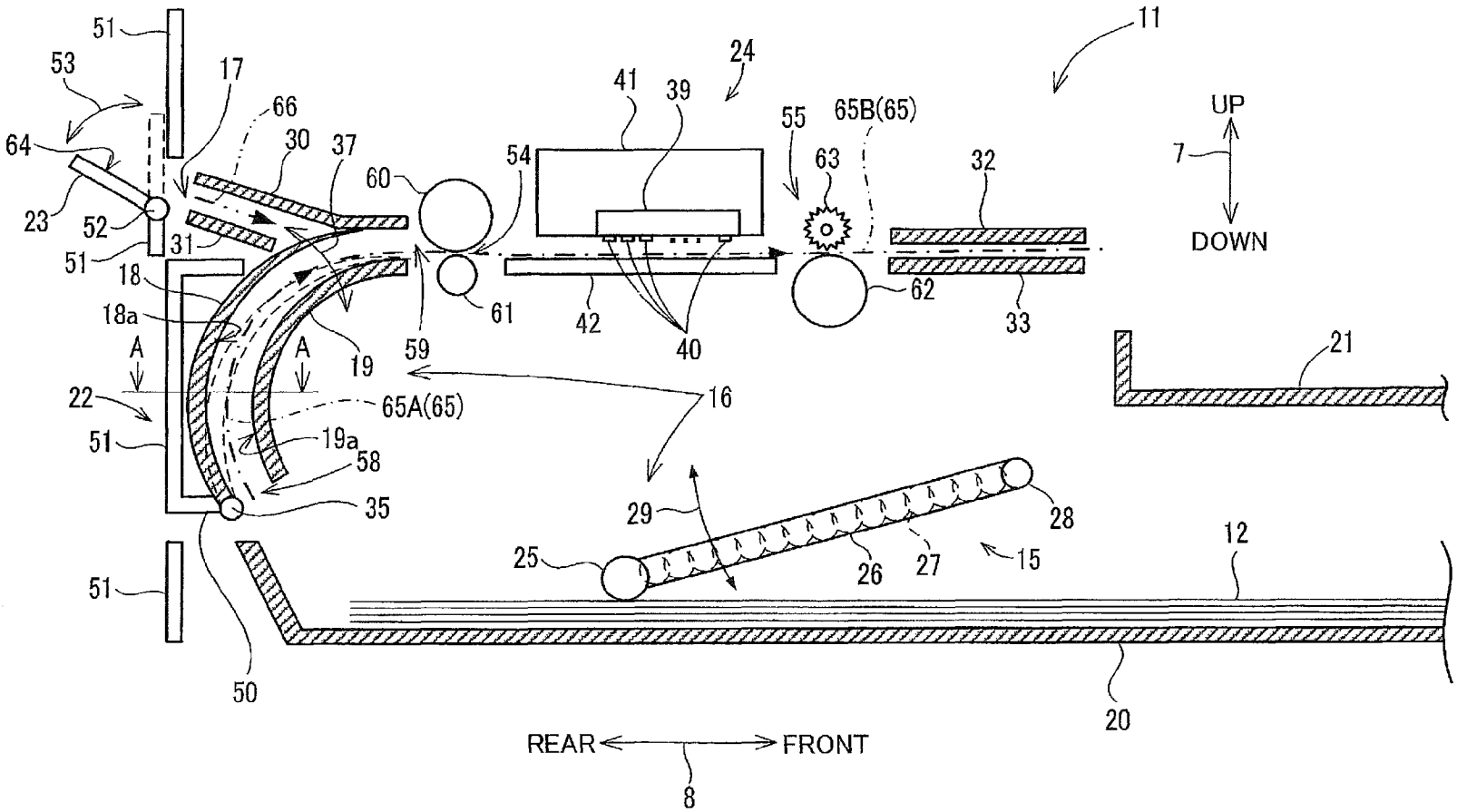
FIG. 2 is a sectional side view of a printing unit in the multifunction peripheral, schematically showing the internal configuration of the printing unit.

As shown in FIG. 2, the printing unit 11 includes a conveying mechanism 16, an inkjet-type recording unit 24, a pair of first conveying rollers 54, and a pair of second conveying rollers 55. The conveying mechanism 16 has a feeding unit 15 that picks up and conveys a recording sheet 12 from the sheet tray 20. The feeding unit 15 conveys the recording sheet 12 over a first guide part 19*a* of an inner guide member 19

(described later) to the recording unit 24, at which time the recording unit 24 ejects ink droplets onto the recording sheet 12 to record an image. The recording unit 24 is disposed above the sheet tray 20.

Sheet Tray 20

The sheet tray 20 has a generally rectangular parallelepiped shape. The sheet tray 20 is box-shaped with an open top. However, the discharge tray 21 covers the top of the sheet tray 20 on the front side in the embodiment. The recording sheets 12 are stacked on the bottom surface of the sheet tray 20.

Feeding Unit 15

As shown in FIG. 2, the feeding unit 15 includes a feeding roller 25, a feeding arm 26, and a drive transmission mechanism 27. The feeding unit 15 is disposed above the sheet tray 20 and below the recording unit 24. The feeding roller 25 is rotatably supported on one end of the feeding arm 26. The feeding arm 26 is capable of pivoting in the direction indicated by an arrow 29 about a shaft 28 provided on another end of the feeding arm 26. Through this pivoting, the feeding roller 25 can move between a position in contact with the sheet tray 20 and a position separated therefrom. In other words, the feeding roller 25 can be placed in contact with recording sheet 12 loaded in the sheet tray 20.

The feeding roller 25 is driven to rotate by a drive force transmitted from a feeding motor (not shown). While contacting the topmost recording sheet 12 stacked in the sheet tray 20, the feeding roller 25 conveys the recording sheet 12 onto a conveying path 65 described below.

Conveying Path 65

As shown in FIG. 2, the conveying path 65 is divided into a curved path 65A and a straight path 65B. The curved path 65A begins from the rear end of the sheet tray 20 and curves upward and back toward the front side of the MFP 10, while the straight path 65B extends from the upper end of the curved path 65A in the rear side of the MFP 10 toward the front side of the MFP 10. The curved path 65A is formed above the sheet tray 20 and extends from the rear end of the sheet tray 20 to a first conveyor 54. While the curved path 65A is substantially arc-shaped in FIG. 2, the curved path 65A is not limited to this shape. For example, the curved path 65A may extend directly upward from the rear end of the sheet tray 20, then curve toward the front. The straight path 65B is a linear path that extends from the first conveyor 54 to the discharge tray 21.

The curved path 65A is formed of an inner guide member 19 and an outer guide 18. Each of the inner guide member 19 and the outer guide 18 are disposed on the opposite side of the first conveyor 54 from the recording unit 24. The inner guide 19 is confronted but separated prescribed distances from outer guide members 18 and a first upper guide member 30 described later. The straight path 65B is provided on the opposite side of a second conveyor 55 from the recording unit 24 and is defined by a second upper guide member 32 and a second lower guide member 33 confronting each other vertically at a prescribed distance. The straight path 65B is also formed partially between the first conveyor 54 and second conveyor 55 by a platen 42 described later. The outer guide members 18, inner guide member 19, second upper guide member 32, and second lower guide member 33, as well as the first upper guide member 30 (described later) and a first lower guide member 31 (described later) all extend in the direction orthogonal to the plane of the drawing in FIG. 2 (the left and right directions 9 in FIG. 1). Each of the guide members will be described later in greater detail.

The conveying path 65 specifically extends from a first end 58 of the outer guide members 18 and inner guide member 19 on the sheet tray 20 side, passing through a second end 59 of the outer guide members 18 and inner guide member 19 on the first conveyor 54 side, through the nip position between the first conveyor 54, above the platen 42, and through the nip position between the second conveyor 55 to arrive at the discharge tray 21. The feeding roller 25, first conveyor 54, and second conveyor 55 convey the recording sheet 12 along the conveying path 65 in the conveying direction. The conveying direction is the direction indicated by the arrows with single dotted chain lines in FIG. 2.

Thus, when conveyed by the feeding roller 25 of the sheet tray 20, the recording sheet 12 is guided through the first end 58 and second end 59 of the curved path 65A to the recording unit 24. In other words, the recording sheet 12 is guided along the U-shaped curved path 65A from the bottom to the top of the MFP 10 so as to be redirected from a rearward direction to a forward direction. After the recording unit 24 has recorded an image on a recording sheet 12, the sheet is guided onto the discharge tray 21.

Manual Feed Tray 23 and Manual Feed Conveying Path 66

As shown in FIG. 2, a manual feed tray 23 is disposed on a rear surface 51 of the MFP 10. The manual feed tray 23 is capable of opening and closing an opening 17 formed in the rear surface 51 by rotating in directions indicated by arrows 53 about a shaft 52. The manual feed tray 23 is depicted in its open state by solid lines in FIG. 2, and in its closed state by dashed lines. Recording sheets of various sizes can be placed in the manual feed tray 23 when the manual feed tray 23 is in its open state.

As indicated by a double dotted chain line in FIG. 2, a manual feed conveying path 66 is formed from the rear opening 17 in the rear surface 51 toward the second end 59 of the curved path 65A, i.e., toward the outer guide members 18 and inner guide member 19. The rear opening 17 is formed on the outer guide members 18 side of the curved path 65A, that is, farther rearward than the curved path 65A. The second end 59 of the outer guide members 18 and inner guide member 19 is positioned obliquely downward and forward of the rear opening 17. Hence, the manual feed conveying path 66 slopes downward and forward from a position outside (on the rear side of) the curved path 65A toward the second end 59 of the curved path 65A. In the embodiment, the rear opening 17 is disposed diagonally above and rearward of the second end 59, but the rear opening 17 may be disposed rearward of, or diagonally downward and rearward of, the second end 59. In these cases, the manual feed conveying path 66 extends forward, or diagonally upward and forward, from the rear opening 17.

The front extended end of the manual feed conveying path 66 converges with the second end 59 of the curved path 65A. In other words, the manual feed conveying path 66 is connected to the curved path 65A at the second end 59. The rear side (manual feed tray 23 side) of the manual feed conveying path 66 is formed by the first upper guide member 30 and the first lower guide member 31 confronting each other with a gap formed therebetween. The front side (first conveyor 54 side) of the manual feed conveying path 66 is formed by the first upper guide member 30 and the inner guide member 19 that confront each other with a gap formed therebetween.

The user inserts a recording sheet 12 through the rear opening 17 in a forward direction. During this operation, the sheet is supported on a sheet support part 64 of the manual feed tray 23 and the first lower guide member 31 and is guided along the manual feed conveying path 66 until the leading edge of the sheet arrives at the nip position in the first conveyor 54.

As described above, the first lower guide member 31 extends from the rear opening 17 formed in the rear surface 51 of the MFP 10 toward the outer guide members 18 and supports the bottom of the recording sheet 12 inserted from outside the rear surface 51 of the MFP 10. The first upper guide member 30 is arranged such that its rear side opposes the first lower guide member 31 while its front side opposes the inner guide member 19.

Conveyors 54 and 55

As shown in FIG. 2, the first conveyor 54 is disposed on the conveying path 65 upstream of the recording unit 24 with respect to the conveying direction. The first conveyor 54 include a first conveying roller 60 and pinch rollers 61. The second conveyor 55 is disposed on the conveying path 65 downstream of the recording unit 24 with respect to the conveying direction. The conveyor 55 includes second conveying rollers 62 and spurs 63.

The first conveying roller 60 and the pinch rollers 61 constituting the first conveyor 54 are in contact with each other and function to nip and convey a recording sheet 12. The second rollers 62 and spurs 63 constituting the second conveyor 55 are in contact with each other and function to nip and convey a recording sheet 12.

Forward and reverse drive forces transmitted from a conveying motor (not shown) drive the first conveying roller 60 and second conveying rollers 62 to rotate in forward and reverse directions. That is, the first conveying roller 60 and second conveying rollers 62 rotate in a direction for conveying the recording sheet 12 in the conveying direction when a forward drive force is transmitted from the conveying motor, and to rotate in a direction for conveying the recording sheet 12 opposite the conveying direction when a reverse drive force is transmitted from the conveying motor.

Platen 42

As shown in FIG. 2, the platen 42 is disposed between the first conveyor 54 and the second conveyor 55 on the bottom side of the straight path 65B. The platen 42 supports the bottom surface of the recording sheet 12 conveyed along the straight path 65B.

Recording Unit 24

As shown in FIG. 2, the recording unit 24 is disposed on the top side of the straight path 65B and confronts the platen 42. That is, the recording unit 24 is positioned downstream of the second end 59 in the conveying direction. The recording unit 24 includes a carriage 41 and a recording head 39. The carriage 41 is supported on guide rails (not shown) disposed on the front and rear sides of the platen 42. A belt mechanism (not shown) well known in the art is disposed on at least one of the guide rails. The carriage 41 is coupled to the belt mechanism, enabling the carriage 41 to move in the left and right directions 9.

As shown in FIG. 2, the recording head 39 is mounted in the carriage 41. A plurality of nozzles 40 is formed in the bottom surface of the recording head 39. Ink is supplied to the recording head 39 from ink cartridges (not shown). The recording head 39 ejects the ink from the nozzles 40 as micro-droplets. The ink droplets are ejected from the nozzles 40 onto the recording sheet 12 supported on the platen 42 as the carriage 41 reciprocates in the left and right directions 9, thereby recording an image on the recording sheet 12. At this time, the recording sheet 12 supported on the platen 42 has passed through the curved path 65A and is being conveyed along the straight path 65B. That is, the recording unit 24 records an image on the portion of recording sheet 12 that has already passed through the curved path 65A.

Conveying Mechanism

As shown in FIG. 2, the conveying mechanism 16 includes the feeding unit 15 described above, as well as the inner guide member 19, the outer guide members 18, a support member 22 (described later), the first upper guide member 30, and the first lower guide member 31.

Inner Guide Member 19

As shown in FIG. 2, the inner guide member 19 for us the inside of the curved path 65A between the first and second ends 58 and 59. The inner guide member 19 is disposed above the sheet tray 20.

The first guide part 19*a* is formed on the side of the inner guide member 19 opposing the outer guide members 18. The first guide part 19*a* is curved to conform to the curvature of the curved path 65A. The first guide part 19*a* functions to guide the recording sheet 12 conveyed along the curved path 65A. The first guide part 19*a* is configured of a curved surface, for example. Alternatively, the first guide part 19*a* may be configured of a plurality of ribs extending in the conveying direction of the recording sheet 12 and protruding from the curved surface toward the curved path 65A. As mentioned earlier, the curved path 65A need not be arc-shaped, but rather may extend straight upward from the rear end of the sheet tray 20, then curve toward the front. In this case, the first guide part 19*a* may be configured of a flat surface or a plurality of ribs extending upward, and a curved surface or a plurality of ribs curving and extending forward from the first flat surface or plurality of ribs. As described above, at least a portion of the first guide part 19*a* is curved and functions to guide recording sheets 12 conveyed by the feeding roller 25. The first guide part 19*a* guides surfaces of the recording sheets that have been contacted by the feeding roller 25.

Outer Guide Members 18

As shown in FIG. 2, the outer guide members 18 form the outside of the curved path 65A between the first and second ends 58 and 59. The outer guide members 18 are disposed rearward from the inner guide member 19 and are closer to the rear surface 51 of the MFP 10, i.e., the outside of the device, than the inner guide member 19.

Second guide parts 18*a* are respectively formed on the side of the outer guide members 18 opposing the inner guide member 19. The second guide parts 18*a* conform to the curvature of the curved path 65A. The second guide parts 18*a* confront the first guide part 19*a*. As with the first guide part 19*a*, the second guide parts 18*a* guide recording sheets 12 conveyed along the curved path 65A. The second guide parts 18*a* are configured of a curved surface, for example. Alternatively, the second guide parts 18*a* may be configured of a plurality of ribs extending along the conveying direction of the recording sheet 12 and protruding from the curved surface toward the curved path 65A. As described earlier, the curved path 65A need not be arc-shaped, but may extend directly upward from the rear end of the sheet tray 20, then curve toward the front. In this case, the each of the second guide parts 18*a* may be configured of a flat surface or a plurality of ribs extending upward, and a curved surface or a plurality of ribs extending from the first flat surface or plurality of ribs. As described above, at least a portion of the second guide parts 18*a* is curved and guides recording sheets 12 conveyed by the feeding roller 25. The second guide parts 18*a* guide surfaces of the sheets that are opposite to the surfaces that have been contacted by the feeding roller 25. That is, the second guide parts 18*a* guide the surfaces of the sheets that have not been contacted by the feeding roller 25.

In the embodiment, the outer guide members 18 become thinner toward the second end 59. That is, the dimension of the outer guide members 18 in a side view (front and rear direction 8) becomes smaller toward the second end 59 side from the dimension on first end 58 side.

Figure 3:
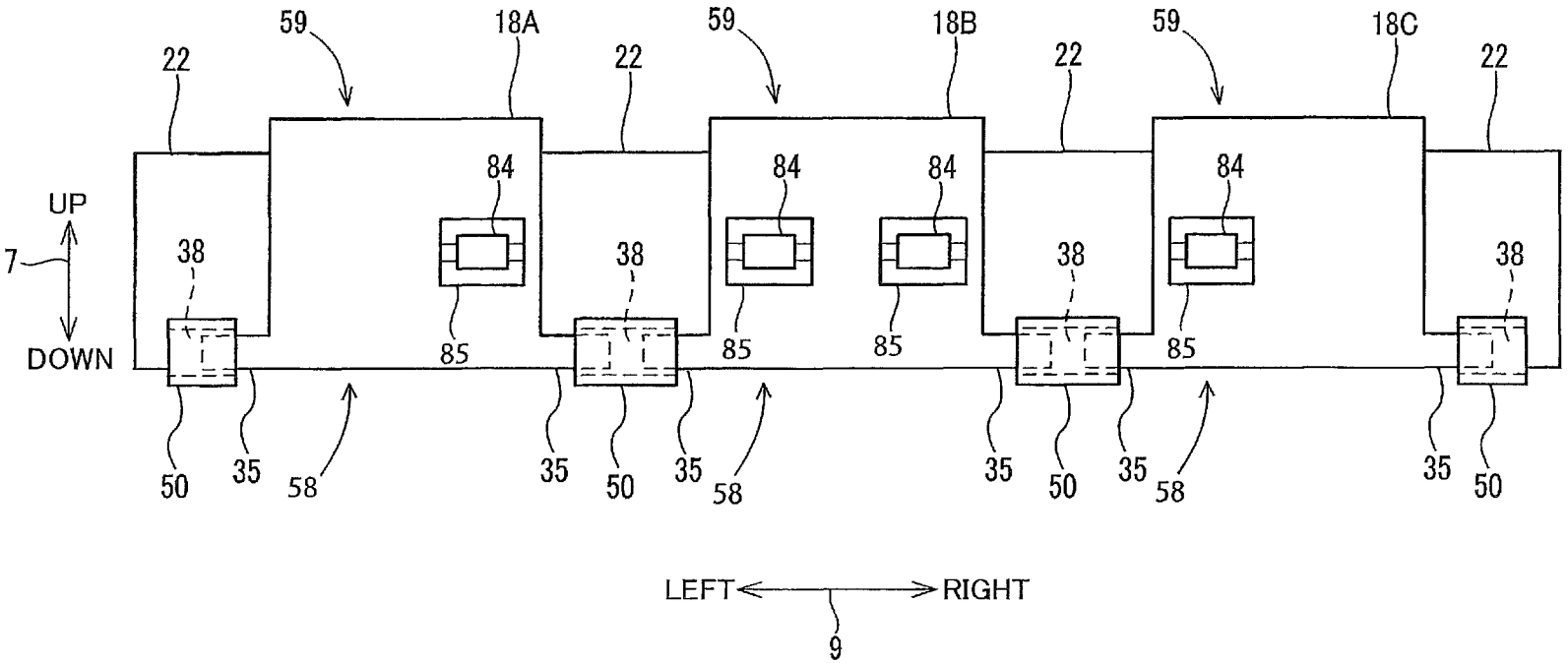
FIG. 3 is a front view schematically showing outer guide members and a support member.

As shown in FIG. 3, the outer guide members 18 of the embodiment include three outer guide members 18A-18C. The outer guide members 18A-18C are arranged at prescribed intervals along the left and right directions 9, i.e., a direction orthogonal to the conveying direction. The number of outer guide members 18 is not limited to three, but may be four or more, for example.

A shaft 35 is provided on the first end 58 of each of the outer guide members 18A-18C. Thus, the shafts 35 are disposed on the outer guide members 18A-18C, individually. The shafts 35 extend in the left and right directions 9 and are rotatably mounted in the support member 22 described later, enabling the outer guide members 18A-18C to pivot individually in the direction indicated by an arrow 37 in FIG. 2.

The distal ends of the outer guide members 18 at the second end 59 are positioned above the inner guide member 19 and below the first upper guide member 30 with respect to the up and down directions 7. The outer guide members 18 having this configuration can pivot between a first position (indicated by dashed lines in FIG. 2) in which the bottoms of the distal ends contact the inner guide member 19, and a second position (indicated by solid lines in FIG. 2) in which the tops of the distal ends contact the first upper guide member 30. That is, in the first position the distal ends of the outer guide members 18 are closer to the inner guide member 19 than to the first upper guide member 30, while in the second position the distal ends are closer to the first upper guide member 30 than to the inner guide member 19.

Figure 4:
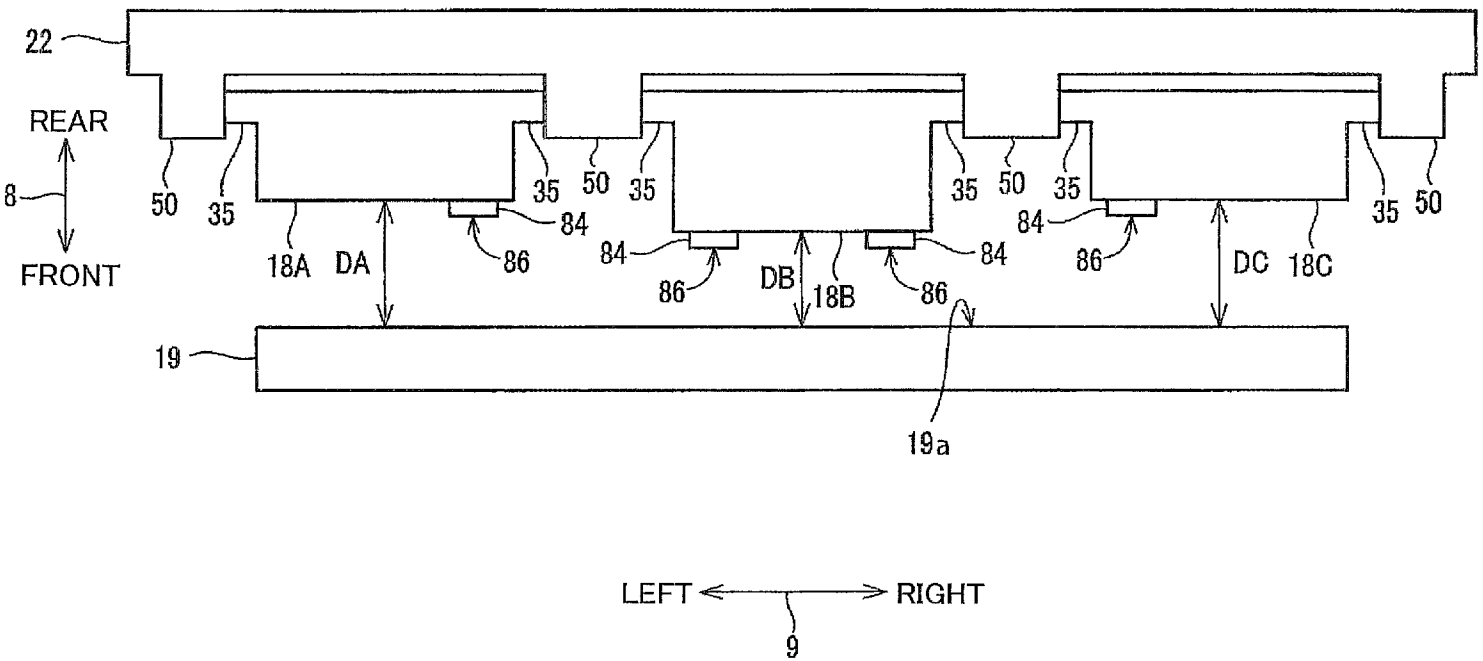
FIG. 4 is a cross-sectional view taken along a line A-A in FIG. 2, to which showing of rollers is added.

As shown in FIG. 4, at least one roller 84 is disposed on the part of each outer guide member 18 facing the first guide part 19*a* of the inner guide member 19. In the embodiment, one roller 84 is disposed on each of the outer guide members 18A and 18C positioned on the ends in the left and right directions 9, while two rollers 84 are disposed on the center outer guide member 18B. However, the number of rollers 84 disposed on each outer guide member 18 is not limited to the numbers in this embodiment.

Next, the process of mounting the rollers 84 in the outer guide members 18 will be described. As shown in FIG. 3, a single opening 85 is formed in each of the outer guide members 18A and 18C, while two openings 85 are formed in the outer guide member 18B. The opening 85 formed in the outer guide member 18A is biased to the right, while the opening 85 formed in the outer guide member 18C is biased to the left. In the outer guide member 18B, one of the openings 85 is biased leftward and the other is biased rightward.

One of the rollers 84 is disposed in each of the openings 85. The rollers 84 are rotatably supported in the outer guide members 18. As shown in FIG. 4, part of a peripheral surface 86 on each roller 84 protrudes from the second guide parts 18*a* toward the first guide part 19*a* and is exposed in the curved path 65A. Note that the rollers 84 may be positioned so that their entire peripheral surfaces 86 protrude into the curved path 65A, but at least part of the peripheral surfaces 86 should protrude into the curved path 65A from the second guide parts 18*a*.

As shown in FIG. 4, the dimensions of the outer guide members 18A and 18C in the front and rear directions 8 are smaller than that of the outer guide member 18B in the embodiment. Consequently, distances DA and DC between the outer guide members 18A and 18C and the inner guide member 19 are greater than a distance DB between the outer guide member 18B and the inner guide member 19 when the outer guide members 18 are in the first position.

When the gaps between the outer guide members 18 and the inner guide member 19 have the relationships described in the embodiment, at least one of the outer guide members 18 must be disposed in the center and on both ends with respect to the left and right directions 9. That is, at least three outer guide members 18 must be disposed at intervals along the left and right directions 9. While the relationships among the distances DA, DB, and DC are defined by the dimensions of the outer guide members 18A, 18B, and 18C in the embodiment, the relationships among these distances may be defined by another method, provided that the same relationships can be maintained. For example, the relationships between these distances may be defined by the layout of the outer guide members 18A, 18B, and 18C. That is, if the outer guide members 18A, 18B, and 18C have the same dimension in the front and rear directions 8, the outer guide members 18A and 18C may be positioned further apart from the first guide part 19*a* than the center outer guide member 18B.

Figure 5A:
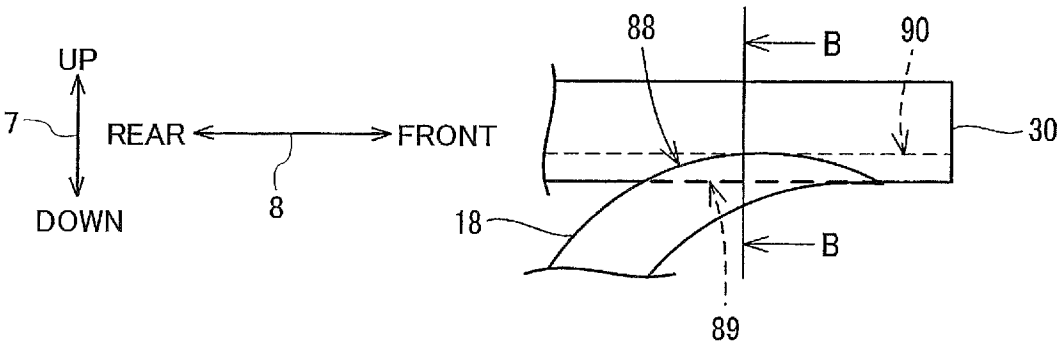
FIG. 5A is a sectional side view schematically showing part of an outer guide member around its distal end.
Figure 5B:
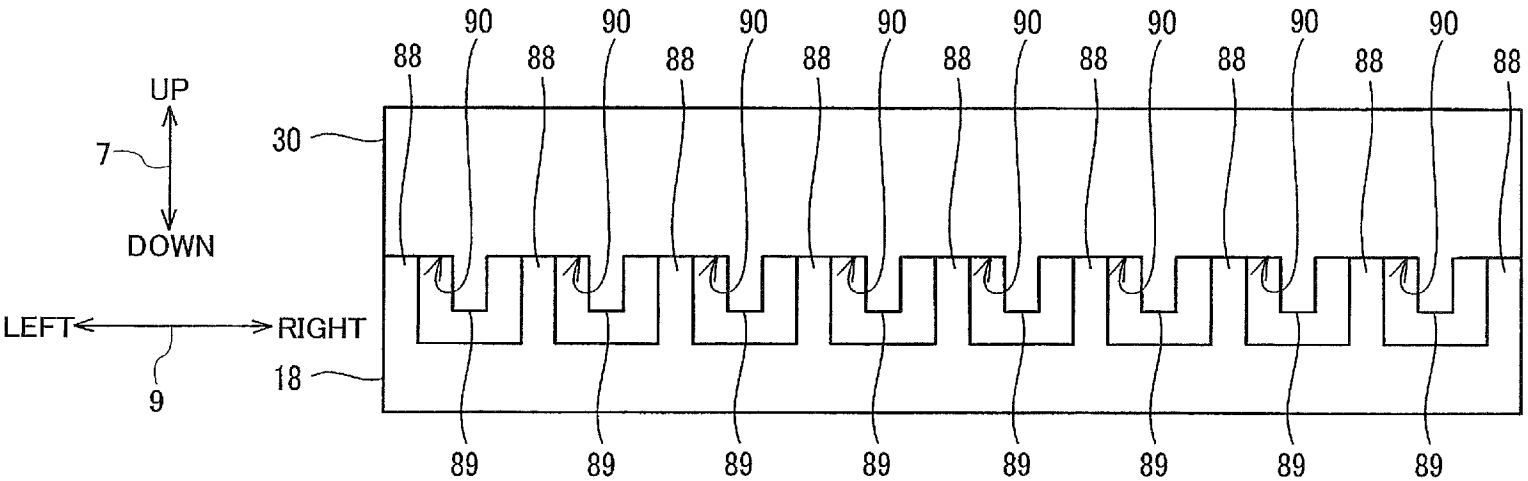
FIG. 5B is a cross-sectional view taken along a line B-B in FIG. 5A.

As shown in FIG. 5A, first ribs 88 are formed on the distal end of each outer guide member 18 in the embodiment. The first ribs 88 extend substantially in the front and rear directions 8, i.e., the directions in which the second guide parts 18*a* extend. As shown in FIG. 5B, each of the first ribs 88 is spaced at intervals along the left and right directions 9.

Support Member 22

As shown in FIG. 2, the support member 22 is disposed at the rear surface 51 of the MFP 10 and cover the outer side of the outer guide members 18. The side of the support member 22 opposite the outer guide members 18 forms part of the rear surface 51 constituting the MFP 10. As shown in FIG. 3, the support member 22 extends in both the up and down directions 7 and left and right directions 9 in a front view. A plurality of protruding parts 50 is formed on the bottom edge of the support member 22 and protrudes forward therefrom. As shown in FIG. 3, a hole 38 is formed in the distal end of each protruding parts 50 and penetrates the same in the left and right directions 9. The shafts 35 of the outer guide members 18A-18C are inserted into corresponding holes 38, whereby the outer guide members 18A-18C can pivot individually about the shafts 35. Hence, the support member 22 supports each of the outer guide members 18A-18C so that the outer guide members 18A-18C pivot individually about their ends on the first end 58 side, that is, the sheet tray 20 side. In addition, the support member 22 may be formed integrally with the outer guide members 18.

First Upper Guide Member 30 and First Lower Guide Member 31

As shown in FIG. 2, the first upper guide member 30 forms the top side of the manual feed conveying path 66. At the second end 59, the first upper guide member 30 is disposed above the inner guide member 19 and faces the same. The first upper member 30 is opposed to the inner guide member 19 and the first lower guide member 31 which are disposed below the first upper guide member 30. In the front and rear direction, the first lower guide member 31 is almost disposed rearward from the inner guide member 19.

As shown in FIG. 5A, second ribs 89 are formed on the front side of the first upper guide member 30 and extend substantially along the front and rear directions 8. As shown in FIG. 5B, each of the second ribs 89 are spaced at intervals in the left and right directions 9. Further, the second ribs 89 are disposed at positions along the left and right directions 9 between adjacent first ribs 88 formed on the outer guide member 18. As shown in FIGS. 5A and 5B, stopping parts 90 are formed on the first upper guide member 30 so as to span between each pair of adjacent second ribs 89. When the outer guide members 18 are in the second position, the first ribs 88 on the outer guide members 18 are inserted between adjacent second ribs 89 and contact the stopping parts 90. This contact restricts the outer guide members 18 from moving farther upward, i.e., farther toward the first upper guide member 30, than necessary.

Pivoting of the Outer Guide Members 18

As described above, the distal ends of the outer guide members 18 are positioned above the second end 59 of the inner guide member 19. In the embodiment, the normal state of the outer guide members 18 is the first position. The outer guide members 18 naturally pivot into the first position by their own weight.

When the feeding unit 15 conveys a recording sheet 12 from the sheet tray 20 while the outer guide members 18 are in the first position, the leading edge of the recording sheet 12 contacts the outer guide members 18 and pushes the outer guide members 18 upward, causing the outer guide members 18 to pivot into the second position. As the outer guide members 18 are pivoted into the second position, the first ribs 88 formed on the outer guide members 18 are inserted between adjacent second ribs 89 formed on the first upper guide member 30. The pivoting of the outer guide members 18 from the first position to the second position is halted when the tops of the first ribs 88 contact the stopping parts 90. Once the trailing edge of the recording sheet 12 has passed the outer guide members 18 so that the outer guide members 18 are no longer pushed upward by the sheet, the outer guide members 18 pivot by their own weight back to the first position in contact with the inner guide member 19. The outer guide members 18 open the manual feed conveying path 66 when the outer guide members 18 are in the first position, and close the manual feed conveying path 66 when the outer guide members 18 are in the second position.

As described in the embodiment, by being in the second position, the outer guide members 18 can reduce the possibility that a recording sheet 12 conveyed by the feeding roller 25 between the inner guide member 19 and outer guide member 18 will be mistakenly guided between the first upper guide member 30 and first lower guide member 31. Further, by being in the first position, the outer guide members 18 can reduce the possibility that a recording sheet 12 supported by the first lower guide member 31 and inserted between the first upper guide member 30 and first lower guide member 31 will be mistakenly guided down between the inner guide member 19 and outer guide member 18. As described above, the conveying path 65 for guiding recording sheets 12 fed from the sheet tray 20 and the manual feed conveying path 66 for guiding recording sheets 12 manually fed by a user converge in the conveying mechanism 16, but the configuration of the conveying mechanism 16 in the embodiment allows the recording sheets 12 to be guided reliably, regardless of which conveying path (the conveying path 65 or manual feed conveying path 66) through which the recording sheet 12 is guided.

By contacting either the inner guide member 19 or the first upper guide member 30 with this construction, the outer guide members 18 block the path along which the recording sheet 12 could be mistakenly guided. Therefore, this construction can reduce the possibility of the recording sheet 12 being guided along the wrong path.

Further, with this configuration, only the outer guide members 18 that are contacted by the recording sheet 12 change position. That is, the size with respect to the left and right directions 9 of the recording sheet 12 conveyed between the inner guide member 19 and outer guide member 18 determines which of the outer guide members 18 change position. In other words, this configuration can reduce the number of outer guide members 18 that change position when the recording sheet 12 has a smaller dimension in the left and right directions 9. Thus, this construction can reduce the amount of resistance that the outer guide members 18 apply to the recording sheet 12 when the recording sheet 12 has a shorter dimension in the left and right directions 9.

Further, the recording sheet 12 guided between the inner guide member 19 and the outer guide members 18A-18C are less likely to contact the outer guide members 18A and 18C outside the center in the left and right directions 9. This configuration can reduce the amount of resistance that the outer guide members 18 apply to the recording sheet 12. The configuration also reduces the potential for skew in the recording sheet 12 caused by the outer guide members 18A and 18C, positioned outside the center of the recording sheet 12 with respect to the left and right directions 9, contacting the recording sheet 12.

In the embodiment described above, rollers 84 are also disposed on the outer guide members 18. Accordingly, even when the outer guide members 18 change positions, the distance at which the rollers 84 protrude from the outer guide members 18 does not change. Accordingly, the recording sheets 12 can be smoothly guided between the inner guide member 19 and outer guide members 18, regardless the position of the outer guide members 18.

In the embodiment, the outer guide members 18 pivot to the second position when a recording sheet 12 contacts and pushes the outer guide members 18, and pivot to the first position by their own weight when the sheet is no longer in contact therewith. Hence, a motor or other special mechanism need not be provided for pivoting the outer guide members 18, thereby achieving a simple structure for pivoting the outer guide members 18.

According to the embodiment, the first ribs 88 provided on the outer guide members 18 are inserted into gaps formed between each pair of adjacent second ribs 89 provided on the first upper guide member 30 when the outer guide members 18 are in the second position. Accordingly, the space for placing the outer guide members 18 in the second position can also serve as the space for constructing the first upper guide member 30, making it possible to reduce the size of the conveying mechanism 16 and, hence, the MFP 10 in general.

According to the embodiment, pivoting of the outer guide members 18 from the first position to the second position is halted when the first ribs 88 contact the stopping parts 90. In other words, pivoting of the outer guide members 18 is halted with the first ribs 88 inserted into gaps between pairs of second ribs 89. With this construction, the space in the manual feed conveying path 66 formed by the first upper guide member 30 and first lower guide member 31 can be reliably blocked. Further, since the outer guide members 18 and the first upper guide member 30 form a continuous surface in this state, the feeding roller 25 can smoothly convey recording sheets 12 through the curved path 65A.

First Variation

In the embodiment described above, the outer guide members 18 contact the inner guide member 19 in the first position and contact the first upper guide member 30 in the second embodiment, but the outer guide members 18 need not contact the inner guide member 19 and first upper guide member 30 in these positions.

For example, first stoppers (not shown) may be disposed in the curved path 65A at positions outside the conveying range of the recording sheet 12 with respect to the left and right directions 9 for halting pivoting of the outer guide members 18 at a first prescribed position approaching the inner guide member 19. Similarly, second stoppers (not shown) may also be disposed in the curved path 65A outside the conveying range of the recording sheet 12 with respect to the left and right directions 9 for halting pivoting of the outer guide members 18 at a second prescribed position approaching the first upper guide member 30.

The first variation described above can reduce the sound of impact generated when the distal ends of the outer guide members 18 contact the inner guide member 19 and first upper guide member 30. This construction can also reduce wear on the guide members 18, 19, and 30.

Second Variation

In the embodiment described above, the outer guide members 18 pivot by their own weight into the first position and pivot into the second position when pushed by a recording sheet 12. However, the outer guide members 18 may be pivoted between first and second positions by the drive force transmitted from a motor or the like.

Third Variation

In the embodiment described above, the support member 22 pivotally supports each of the outer guide members 18A-18C by disposing shafts 35 on the outer guide members 18A-18C that are inserted into holes 38 formed in the support member 22. However, the structure for pivotally supporting the outer guide members 18A-18C is not limited to that described in the embodiment. For example, holes extending in the left and right directions 9 may be formed in the left and right ends of each of the outer guide members 18A-18C. Shafts may additionally be disposed in the support member 22 at positions corresponding to the holes formed in the outer guide members 18A-18C. Hence, the outer guide members 18A-18C are pivotally supported by inserting the shafts disposed on the support member 22 into the holes formed in the outer guide members 18A-18C.

Fourth Variation

In the embodiment described above, the opening 17 through which the user manually inserts a recording sheet 12 is formed in the rear surface 51 of the MFP 10, but the opening 17 may be formed in the left or right surface of the MFP 10, for example. One example of this arrangement is a configuration in which the front and rear directions 8 in FIG. 2 are switched with the left and right directions 9. In this case, the manual feed conveying path 66 extends from the opening 17 formed in the left surface of the MFP 10 to the second end 59 in a direction toward the right surface of the MFP 10. Further, the conveying path 65 extends upward from the left end of the sheet tray 20, curves toward the right side of the MFP 10, and extends from the left side of the MFP 10 toward the right side of the same.

Fifth Variation

When the user manually inserts a recording sheet 12 into the MFP 10 in the embodiment described above, the user inserts the sheet over the manual feed tray 23 and first lower guide member 31 to the conveying rollers 54. However, a feeding roller may be disposed on the rear surface 51 side of the MFP 10 for feeding the recording sheets 12 to the first conveyor 54. Much like the feeding roller 25, this feeding roller would convey recording sheets 12 supported on the manual feed tray 23 and first lower guide member 31 to the nip position in the first conveyor 54.

While the invention has been described in detail with reference to the embodiment and variations thereof, it would be apparent to those skilled in the art that various changes and modifications may be made therein without departing from the spirit of the invention.

For example, the distances DA and DC between the outer guide members 18A and 18C and the inner guide member 19 may be equal to the distance DB between the outer guide member 18B and the inner guide member 19 when the outer guide members 18 are in the first position.

What is claimed is:

1. A conveying apparatus comprising:

a housing;

a conveying roller configured to convey a sheet;

a first guide member that is located at a downstream side of the conveying roller in a sheet conveying direction and that has a first guide part defining an inside of a curved path and configured to guide the sheet conveyed by the conveying roller;

a second guide member that has a second guide part defining an outside of the curved path and configured to guide the sheet conveyed by the conveying roller, the second guide part being disposed opposing the first guide part;

a third guide member defining a manual feed conveying path that converges from an outside of the housing into a downstream-side portion of the curved path in the sheet conveying direction and being configured to support a sheet inserted into the inside of the housing from the outside of the housing;

a fourth guide member defining the manual feed conveying path and being disposed at a position opposing the third guide member and a downstream-side edge portion of the first guide member; and a support member configured to support the second guide member such that the second guide member is pivotable between a first position and a second position, a downstream side edge of the second guide member in the sheet conveying direction being closer to the first guide member than to the fourth guide member when the second guide member is in the first position, the downstream side edge of the second guide member being closer to the fourth guide member than to the first guide member when the second guide member is in the second position.

2. The conveying apparatus as claimed in claim 1, wherein the downstream side edge of the second guide member is in contact with the first guide member when the second guide member is in the first position and is in contact with the fourth guide member when the second guide member is in the second position.

3. The conveying apparatus as claimed in claim 1, wherein the support member supports the second guide member such that the second guide member is pivotable relative to the support member about an axis that is disposed on an upstream-side edge of the second guide member in the sheet conveying direction, a plurality of the second guide members are arranged in an axial direction in which the axis extends, and the support member supports the second guide members such that the second guide members are individually pivotable.

4. The conveying apparatus as claimed in claim 3, wherein the second guide members include an inner-side second guide member that is located at an inner side of the second guide members in the axial direction and a pair of outer-side second guide members that are located at a pair of outer sides in the second guide members in the axial direction, and when the second guide members are in the first position, a distance between the inner-side second guide member and the first guide member is smaller than or equal to distances between the outer-side second guide members and the first guide member.

5. The conveying apparatus as claimed in claim 1, wherein the support member supports the second guide member such that the second guide member is pivotable about an axis that is disposed on an upstream side edge of the second guide member in the sheet conveying direction, the second guide member has a plurality of first ribs, the first ribs being provided on a downstream-side edge of the second guide member in the sheet conveying direction, the first ribs extending in a direction in which the second guide part extends, the first ribs being arranged in an axial direction in which the axis extends, the fourth guide member has a plurality of second ribs, the second ribs extending in the direction in which the second guide part extends, the second ribs being disposed between adjacent first ribs provided on the second guide member when the second guide member is in the second position.

6. The conveying apparatus as claimed in claim 1, wherein the second guide member has at least one roller at its part confronting the first guide part, at least part of a peripheral surface on the roller protruding from the second guide part in a direction toward the first guide part.

7. The conveying apparatus as claimed in claim 1, wherein the second guide member is in the first position due to its own weight and is pushed by a sheet passing the second guide part to pivot into the second position.

8. The conveying apparatus as claimed in claim 1, wherein the support member supports the second guide member such that the second guide member is pivotable relative to the support member about an axis that is disposed on an upstream side edge of the second guide member in the sheet conveying direction.

9. The conveying apparatus as claimed in claim 1, wherein the conveying roller is configured to contact a first surface of the sheet mounted on a sheet mounting portion, thereby conveying the sheet, the first guide part guides the sheet by contacting the first surface of the sheet, and the second guide part guides the sheet by contacting a second surface of the sheet, the second surface is opposite to the first surface.

10. An image recording apparatus comprising:

the conveying apparatus claimed in claim 1; and a recording unit that is configured to record an image on a portion of a sheet that has passed the first guide part by being conveyed by the conveying roller.

11. A conveying apparatus comprising:

a housing;

a conveying roller configured to convey a sheet;

an inner guide member located at a downstream side of the conveying roller in a sheet conveying direction and defining an inside of a curved path;

an outer guide member located at a downstream side of the conveying roller in the sheet conveying direction and defining an outside of the curved path;

a manual feed guide member defining a manual feed conveying path that converges from an outside of the housing into a downstream-side portion of the curved path in the sheet conveying direction; and a support member configured to support the outer guide member such that the outer guide member is pivotable between a first position and a second position, the outer guide member being configured to open the manual feed conveying path when the outer guide member is in the first position and being configured to close the manual feed conveying path when the outer guide member is in the second position.

* * * * *